US007452032B1

(12) United States Patent
Roleder et al.

(10) Patent No.: US 7,452,032 B1
(45) Date of Patent: Nov. 18, 2008

(54) ARMREST ASSEMBLY FOR A RESTING DEVICE

(75) Inventors: Jon W. Roleder, San Diego, CA (US); William W. Chow, Del Mar, CA (US); Oscar Mendez, Temecula, CA (US)

(73) Assignee: Earthlite Massage Tables, Inc., Vista, CA (US)

( * ) Notice: Subject to any disclaimer, the term of this patent is extended or adjusted under 35 U.S.C. 154(b) by 0 days.

(21) Appl. No.: 11/526,926

(22) Filed: Sep. 26, 2006

Related U.S. Application Data

(60) Provisional application No. 60/721,382, filed on Sep. 27, 2005.

(51) Int. Cl.
*A47C 7/54* (2006.01)
*A47C 7/62* (2006.01)
*A61G 15/00* (2006.01)

(52) U.S. Cl. ..... 297/330; 297/411.33; 297/411.35; 297/411.37; 297/188.01; 297/188.14; 297/182

(58) Field of Classification Search ..... 297/411.35, 297/411.33, 188.14, 188.16, 188.19, 188.01, 297/182, 411.37, 330
See application file for complete search history.

(56) References Cited

U.S. PATENT DOCUMENTS 1,706,634 A * 3/1929 Seils ..... 297/411.35 X
1,721,221 A * 7/1929 Jauregui ..... 297/411.35 X
2,263,863 A * 11/1941 Wolfe ..... 297/182 X
2,526,576 A * 10/1950 Nelson ..... 297/182
3,245,716 A * 4/1966 Danner ..... 297/182 X
3,278,008 A * 10/1966 Larkin ..... 297/188.2 X
3,635,522 A * 1/1972 Kerwit ..... 297/118 X
D278,367 S 4/1985 Sussman
4,961,610 A * 10/1990 Reeder et al. ..... 297/411.35
5,029,941 A * 7/1991 Twisselmann ..... 297/411.33 X
5,056,863 A 10/1991 De Kraker
5,281,001 A * 1/1994 Bergsten et al. ..... 297/411.35 X
5,369,805 A * 12/1994 Bergsten et al. ..... 297/411.35
5,380,065 A * 1/1995 Rohrer ..... 297/411.357
5,393,124 A * 2/1995 Neil ..... 297/411.35
5,407,249 A * 4/1995 Bonutti ..... 297/411.35
5,641,203 A * 6/1997 Van De Riet et al. .... 297/411.37
5,651,586 A 7/1997 Groth
5,655,814 A * 8/1997 Gibbs ..... 297/411.35 X
5,678,896 A * 10/1997 Chung ..... 297/411.33 X
5,851,054 A * 12/1998 Bergsten et al. ..... 297/411.35
5,884,974 A * 3/1999 Bergsten et al. ..... 297/411.35
5,909,864 A * 6/1999 Wang ..... 297/411.33 X (Continued)

*Primary Examiner*—Rodney B. White
(74) *Attorney, Agent, or Firm*—Roeder & Broder LLP

(57) ABSTRACT

A resting device assembly for supporting a person during a procedure includes a resting device and an armrest. The resting device supports the person during the treatment and includes a device frame. The armrest includes an arm support, a frame bracket, a frame pivot, and a support arm pivot. The arm support supports an arm of the person. The frame pivot connects the frame bracket to the device frame, and allows the frame bracket and the arm support to concurrently pivot relative to the device frame. The support arm pivot connects the arm support to the frame bracket and allows the arm support to pivot relative to the frame bracket. In certain embodiments, the two pivots of the armrest assembly allows for improved adjustability of the armrest. As a result thereof, the person is more comfortable during the manicure or other procedure.

25 Claims, 8 Drawing Sheets

U.S. PATENT DOCUMENTS 5,971,484 A * 10/1999 Lamart et al. ..... 297/411.37
5,975,640 A * 11/1999 Chen ..... 297/411.37
6,053,577 A * 4/2000 Arko et al. ..... 297/411.35
6,053,578 A 4/2000 van Hekken et al.
6,074,012 A * 6/2000 Wu ..... 297/411.35 X
6,086,156 A * 7/2000 Breen et al. ..... 297/411.37
6,095,598 A * 8/2000 Piretti ..... 297/411.35 X
D435,377 S 12/2000 Galati, Jr.
6,176,550 B1 * 1/2001 Lamart et al. ..... 297/411.37
6,213,556 B1 * 4/2001 Chen ..... 297/411.35
6,290,300 B1 * 9/2001 Sutton et al. ..... 297/411.37
6,302,486 B1 * 10/2001 Lamart et al. ..... 294/411.37
6,520,587 B2 * 2/2003 Noiseux ..... 297/411.37
6,588,847 B2 * 7/2003 Murakami ..... 297/411.37
6,619,598 B2 * 9/2003 De Miranda ..... 297/411.35 X
6,619,747 B2 * 9/2003 Ko et al. ..... 297/411.35 X
6,843,534 B2 * 1/2005 Lee et al. ..... 297/411.35
D505,021 S 5/2005 Kim
6,942,289 B2 * 9/2005 McBride ..... 297/188.14
6,948,774 B2 9/2005 Maier
6,948,775 B2 * 9/2005 Tsai ..... 297/411.37
7,052,082 B1 * 5/2006 Thomas ..... 297/182 X
7,055,910 B2 * 6/2006 Wright ..... 297/411.35
7,080,885 B2 * 7/2006 Bain et al. ..... 297/411.35 X
2006/0202541 A1 * 9/2006 Armo et al. ..... 297/411.35
2007/0057540 A1 * 3/2007 Brenner ..... 297/188.01

* cited by examiner

ARMREST ASSEMBLY FOR A RESTING DEVICE

RELATED APPLICATION

This application claims the benefit of U.S. Provisional Application Ser. No. 60/721,382 filed on Sep. 27, 2005. The contents of U.S. Provisional Application Ser. No. 60/721,382 are incorporated herein by reference.

BACKGROUND

Salon chairs are commonly used in salons as a place for a person to sit while a procedure is being performed on that person. One type of procedure commonly done in a salon is a manicure treatment on the fingernails of the person. One type of salon chair includes an armrest assembly having a left armrest for supporting the left arm of the person during the manicure treatment on the left hand, and a right armrest for supporting the right arm of the person during the manicure treatment on the right hand.

It should be appreciated that every person is different in size and shape. Unfortunately, existing armrest assemblies do not provide an adequate range of adjustment so that people of different sizes can comfortable use the armrest assembly.

SUMMARY

A resting device assembly for supporting a person during a procedure includes a resting device and a first armrest. The resting device supports the person during the treatment and includes a device frame. The first armrest includes an arm support, a frame bracket, a frame pivot, and a support arm pivot. The arm support supports an arm of the person. The frame pivot connects the frame bracket to the device frame, and allows the frame bracket and the arm support to concurrently pivot relative to the device frame. The support arm pivot connects the arm support to the frame bracket and allows the arm support to pivot relative to the frame bracket. In certain embodiments, the two pivots of the armrest assembly allows for improved adjustability of the armrest. As a result thereof, the person is more comfortable during the manicure or other procedure.

In one embodiment, the arm support including a hand end and an elbow end, and the support arm pivot connects to the arm support intermediate the hand end and the elbow end so that the hand end and the elbow end pivot about a support arm axis of rotation. For example, the support arm pivot can connect to the arm support approximately half way between the hand end and the elbow end.

In another embodiment, the arm support includes a first support area that supports the first arm near a hand of the first arm, a second support area that supports the arm near an elbow/forearm of the arm, and a support area pivot that allows the first support area to pivot relative to the second support area. Further, in this embodiment, the arm support can include a fluid bowl that retains a fluid, and the fluid bowl is secured to the arm support so that the first support area pivots relative to the fluid bowl. Moreover, the first support area can be pivotable between a first position in which the first support area covers the fluid bowl and a second position in which the first support area does not cover at least a portion of the fluid bowl. With this design, the fluid bowl is retained in a secure fashion. This reduces the likelihood of spilling any fluid from the fluid bowl.

Additionally, the arm support can include a support base having a base aperture for receiving the fluid bowl. This feature allows the fluid bowl to be easily inserted and removed from the arm support.

Moreover, in certain embodiments, the resting device is moveable between a seated position and a flat position.

The present invention is also directed to a method for supporting a person during a procedure. The method includes the steps of: (i) supporting the person with a resting device, the resting device including a device frame; (ii) providing an arm support that supports the arm; (iii) securing a device bracket to the device frame; (iv) providing a frame bracket; (v) connecting the frame bracket to the device bracket with a frame pivot that allows the frame bracket and the arm support to concurrently pivot relative to the device frame; and (vi) connecting the arm support to the frame bracket with a support arm pivot that that allows the arm support to pivot relative to the frame bracket.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
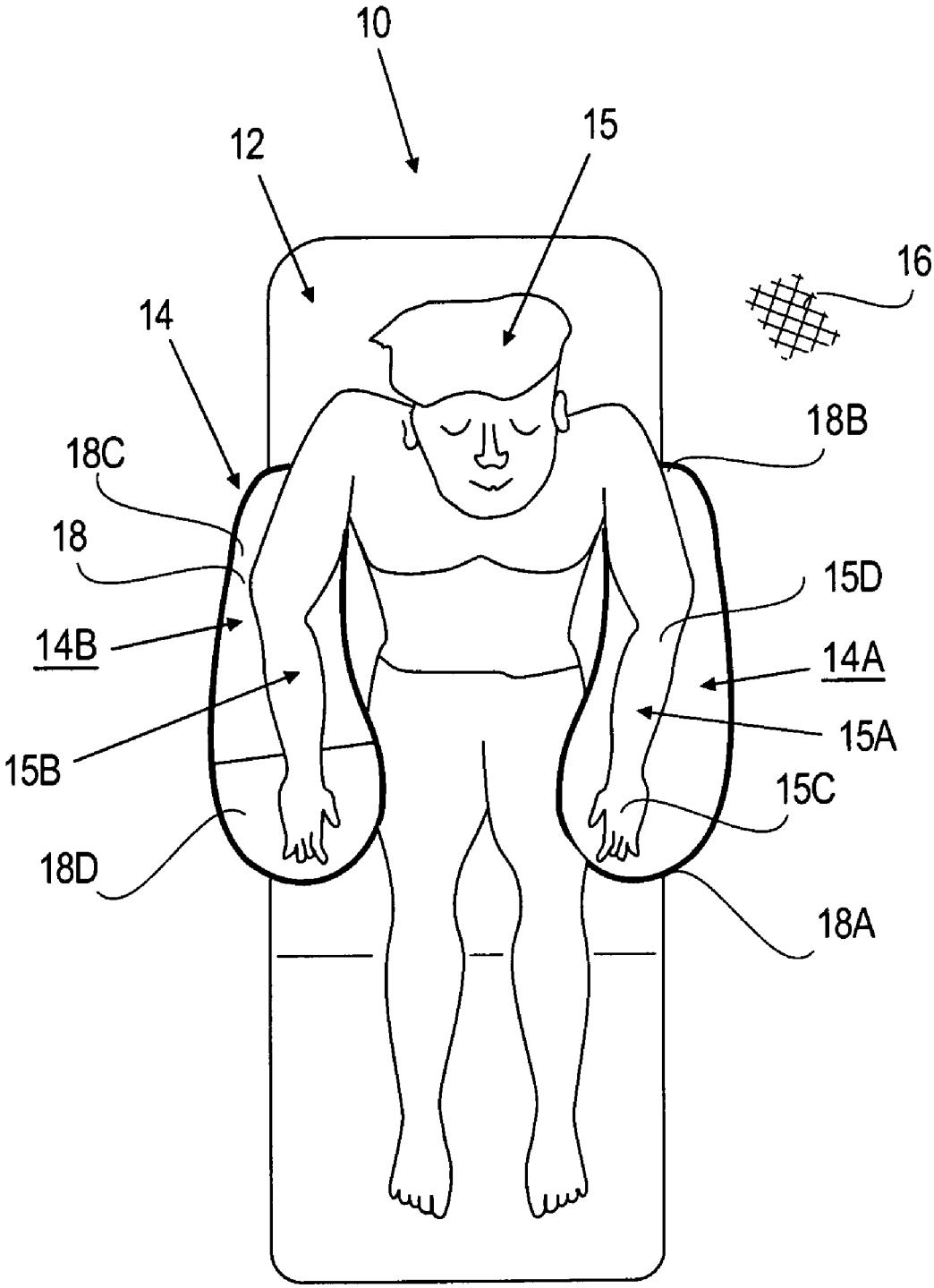
FIG. 1 is a simplified top view of a resting device assembly having features of the present invention and a person.

FIG. 1 is a simplified top view of a resting device assembly 10 including a resting device 12 and an armrest assembly 14 that support a person 15 above a surface 16 during a procedure. The design of each of these components can varied pursuant to the teachings provided herein. In one embodiment, the armrest assembly 14 includes a left armrest 14A that supports a left arm 15A of the person 15, and a right armrest 14B that supports a right arm 15B of the person 15. It should be noted that the left armrest 14A and/or the right armrest 14B can alternatively be referred to as the first armrest or the second armrest. Further, the left arm 15A and/or the right arm 15B can alternatively be referred to as the first arm or the second arm. The resting device assembly 10 can be used in a beauty salon for manicures and other procedures. Further, in certain embodiments, the resting device assembly 10 can be used to give a massage to the person 15.

As an overview, in certain embodiments, the armrest assembly 14 allows for improved adjustability of the armrests 14A, 14B. As a result thereof, the person 15 is more comfortable during the manicure procedure. Further, the armrest assembly 14 retains a fluid bowl 232 (illustrated in FIG. 2) in an improved fashion. This reduces the likelihood of spilling any fluid from the fluid bowl 232.

In FIG. 1, each of the armrests 14A, 14B includes an arm support 18 that supports the respective arm 15A, 15B. In one embodiment, each arm support 18 includes a hand end 18A that is near a hand 15C of the person 15, and an opposed elbow end 18B that is near an elbow 15D of the person 15. Further, each arm support 18 can be divided into an elbow/forearm support area 18C that supports the respective arm 15A, 15B near the elbow 15D and the forearm, and a hand support area 18D that supports the arm 15A, 15B near the hand 15C. It should be noted that the elbow/forearm support area 18C and/or the hand support area 18D can alternatively be referred to as the first support area or the second support area.

Figure 2:
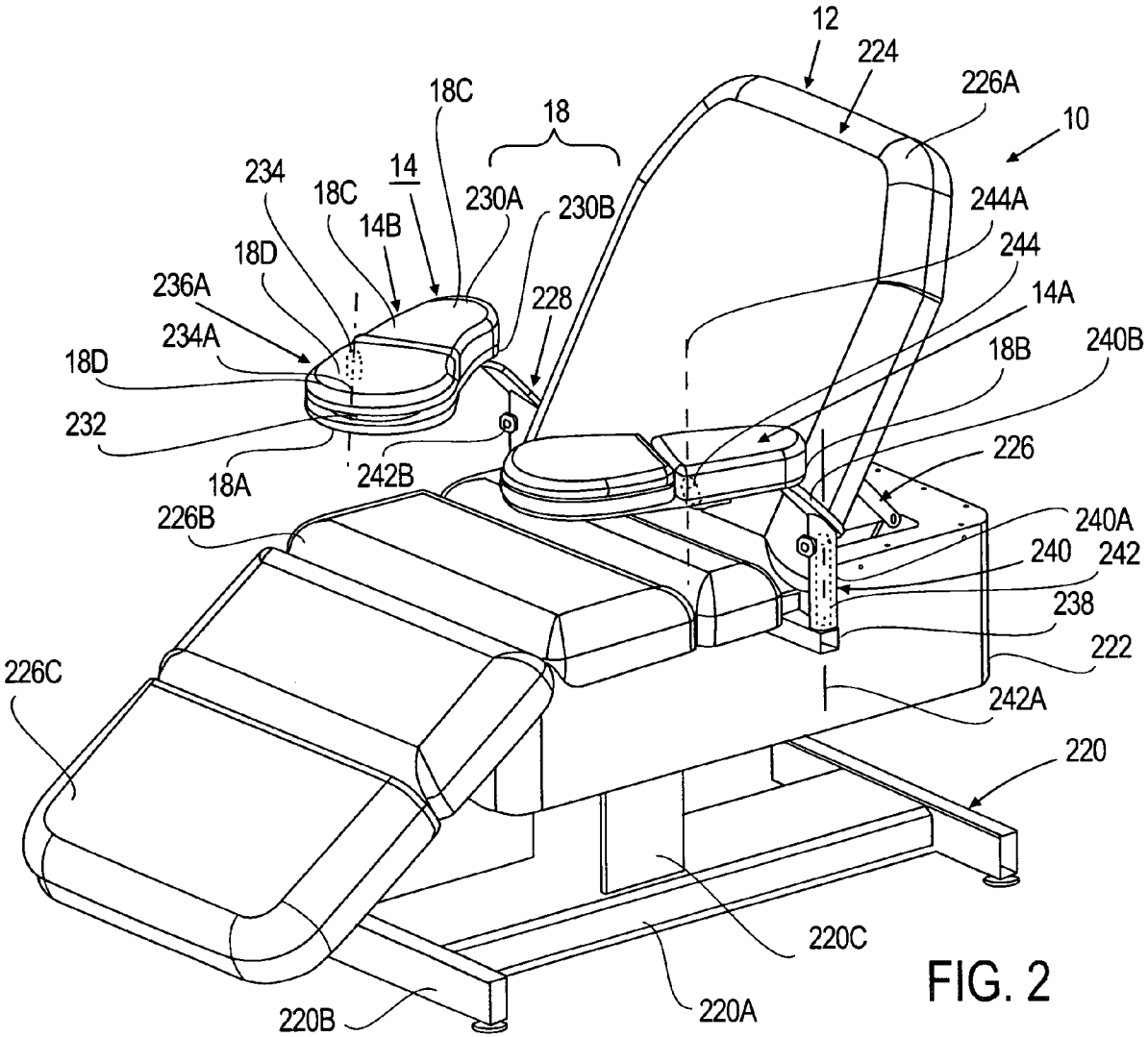
FIG. 2 is a simplified perspective view of one embodiment of a resting device assembly having features of the present invention.

FIG. 2 is a perspective view of one embodiment of the resting device assembly 10 including the resting device 12 and the armrest assembly 14. In this embodiment, the resting device 12 is a salon type table/chair that is movable between a seated position illustrated in FIG. 2 for performing a manicure or another procedure, and a flat bed position (not shown) for performing a massage. One embodiment of a suitable resting device assembly 10 is described in U.S. Pat. No. 6,163,904, the contents of which are incorporated herein by reference. Alternatively, for example, the resting device 12 can have another design. For example, the resting device 12 can be a chair that is not movable to a flat position.

In FIG. 2, the resting device 12 includes a lower device frame 220, an upper device frame 222, a frame mover (not shown), a padded region 224, and a region mover assembly 226. The size, shape, and functions of these components can be varied pursuant to the teachings provided herein.

The lower device frame 220 is rigid and engages the surface 16 (illustrated in FIG. 1). In FIG. 2, the lower device frame 220 include a lower beam 220A, a pair of spaced apart end beams 220B, and an upward beam 220C that extends upward from the lower beam 220A.

The upper device frame 222 is rigid. In FIG. 2A, the upper device frame 222 is generally rectangular tube shaped.

The frame mover moves the upper device frame 222 and the padded region 224 up and down relative to the surface 16. With this design, the height of the person 15 (illustrated in FIG. 1) relative to the surface 16 can be easily adjusted. For example, the frame mover can include one or more electrical motors. Alternatively, the upper device frame 222 can be moved manually and/or the resting device 12 can be designed so that the upper device frame 222 does not move relative to the lower device frame 220.

The padded region 224 provides a cushioned area for the person to rest upon. In FIG. 2, the padded region 224 includes an upper region 226A that supports the upper portion of the person 15, an intermediate region 226B that supports the intermediate portion of the person 15, a lower region 226C that supports the lower portion of the person 15. In this embodiment, each of the regions 226A-226C includes one or more pads, e.g. foam, that are covered with a resilient material, e.g. leather or vinyl.

The region mover assembly 226 moves one or more of the regions 226A-226C relative to the upper device frame 222 to move the padded region 224 between the seated position and the flat bed position. For example, the region mover assembly 226 can include one or more electrical motors and/or linkages. Alternatively, the regions 226A-226C can be moved manually and/or the resting device 12 can be designed so that the regions 226A-226C do not move relative to the upper device frame 222.

The armrest assembly 14 provides a place to rest the arms 15A, 15B (illustrated in FIG. 1) during the procedure. As provided above, the armrest assembly 14 includes the left armrest 14A and the right armrest 14B. The armrests 14A, 14B can be selectively or permanently attached to the resting device 12 so that the resting device 12 can be transformed from a massage table into a salon chair. In FIG. 2, the left armrest 14A is attached to the left side of the resting device 12 and the right armrest 14B is attached to the right side of the resting device 12.

The design of each armrest 14A, 14B can vary. In FIG. 2, each of the armrests 14A, 14B are functionally equivalent. In this embodiment, each armrest 14A, 14B includes (i) the arm support 18, and (ii) an articulated armrest frame assembly 228 that secures the arm support 18 to the resting device 12. For each of the armrests 14A, 14B, the armrest frame assembly 228 allows for improved adjustability of the respective armrests 14A, 14B. As a result thereof, the person 15 is more comfortable during the manicure or other procedure.

In one embodiment, each arm support 18 includes a support area 230A and a support base 230B. In this embodiment, the support area 230A provides a padded area for resting the respective arm 15A, 15B of the person 15 to minimize pressure points on the respective arm 15A, 15B.

The support base 230B provides a rigid region for supporting the support area 230A and coupling the arm support 18 to the armrest frame assembly 228. In FIG. 2, the support base 230B is somewhat oblong shaped and is made of a rigid material such as a hard plastic, aluminum, or wood, for example.

Additionally, as discussed above, the support area 230A can include the first support area 18C that supports the elbow/forearm area 15D of the person 15, and the second support area 18D that supports the hand area 15C of the person 15. In this embodiment, each support area 18C, 18D includes a pad, such as foam, that covered with a durable, water resistant, resilient material, such as leather or vinyl.

Moreover, in one embodiment, each arm support 18 can include a fluid bowl 232 (only partly shown in FIG. 2) that is secured to the support base 230B. For example, the fluid bowl 232 can be a manicure bowl that is used to hold water, or other fluids 131A (illustrated in FIG. 7) for cleaning the finger nails and/or to assist in the manicure procedure. The location of the fluid bowl 232 can be varied to suit the procedure being performed on the person 15. In FIG. 2, the fluid bowl 232 is positioned below the hand support area 18D.

Further, in FIG. 2, the elbow/forearm support area 18C is fixedly secured to the support base 230B, and the hand support area 18D is pivotable connected to the support base 230B with a support area pivot 234 (only one is illustrated in phantom). For example, the support area pivot 234 can be a bolt that connects the hand support area 18D to the support base 230B while allowing the hand support area 18D to rotate relative to the elbow/forearm support area 18C and the support base 230B about a support area axis of rotation 234A. With this design, the hand support area 18D can be selectively moved between (i) a closed position 236A in which the hand support area 18D can support the respective hand 15C and the hand support area 18D covers the fluid bowl 232; and (ii) a open position 236B (illustrated in FIG. 6) in which the hand support area 18D is moved to expose the fluid bowl 232 so that the respective hand 15C can be positioned in the fluid bowl 232 while the rest of the arm 15A, 15B is still being supported by the elbow/forearm support area 18C. It should be noted that the closed position 236A and/or the open position 236B can alternatively be referred to as a first position or a second position.

For each arm support 18, the armrest frame assembly 228 secures the arm support 18 to the resting device 12, and allows for movement of the arm support 18 relative to the resting device 12 to allow the person 15 to easily enter onto or exit from the resting device 12, and allows the arm supports 18 to be positioned to meet the size of the person 15.

In one embodiment, each armrest frame assembly 228 includes (i) a device bracket 238, (ii) a frame bracket 240, (iii) a frame pivot 242 (one is illustrated in phantom), and (iv) a support arm pivot 244 (one is illustrated in phantom). The design of each of these components can be varied pursuant to the teachings provided herein to provide the desired level of adjustability.

The device bracket 238 is rigid and is fixedly secured to the resting device 12. In FIG. 2, the device bracket 238 includes a generally rectangular shaped tube that is secured to and cantilevers away from the resting device 12.

The frame bracket 240 is rigid and extends between the device bracket 238 and the support base 230B. In FIG. 2, the frame bracket 240 is a somewhat "L" shaped bracket that includes a tubular shaped, vertical section 240A that extends upward from the device bracket 238, a flat plate shaped, angled section 240B that extends at approximately a 45 degree angle from the top of the vertical section 240A, and a flat plate shaped, transverse section 240C (illustrated in FIG. 3) that extends at approximately a 45 degree angle from the top of the angled section 240B. Alternatively, the frame bracket 240 can have another shape or configuration.

The frame pivot 242 connects the frame bracket 240 to the device bracket 238 and allows the frame bracket 240 and the arm support 18 to concurrently pivot relative to the device bracket 238 and the resting device 12 about a frame axis of rotation 242A. The design of the frame pivot 242 can vary. In FIG. 2, the frame pivot 242 is a tubular shaped rod that extends upward from the device bracket 238 and fits within the vertical section 240A of the frame bracket 240. Additionally, the frame pivot 242 can include a frame lock 242B that can selectively lock the frame pivot 242 and inhibit relative rotation between the frame bracket 240 and the device bracket 238. In FIG. 2, the frame lock 242 include a knob with a threaded member that threads into the vertical section 240A and engages the rod to selectively inhibit relative movement between the frame bracket 240 and the device bracket 238.

The support arm pivot 244 connects the arm support 18 to the frame bracket 240 and allows the arm support 18 to pivot relative to the frame bracket 240 about a support arm axis of rotation 244A. The design of the support pivot 244 can vary. In FIG. 2, the support pivot 244 is a pin that extends downward from the arm support 18 and fits into an aperture in the transverse section 240B. Alternatively, the support pivot 244 can have a different design.

In one embodiment, the support pivot 244 connects to the arm support 18 intermediate the hand end 18A and the elbow end 18B so that the hand end 18A and the elbow end 18B pivot about the support arm axis of rotation 244A. In certain embodiments, the support pivot 244 connects to the arm support 18 approximately half way between the hand end 18A and the elbow end 18B. Stated in another fashion, support pivot 244 allows the hand support area 18D and the elbow/forearm support area 18C to pivot about the support arm axis of rotation 244A.

As discussed in more detail below, because each armrest 14A, 14B pivots at two locations, the arm supports 18 can be moved and positioned over a relatively wide range to easily and comfortably support different sized persons 15.

Figure 3:
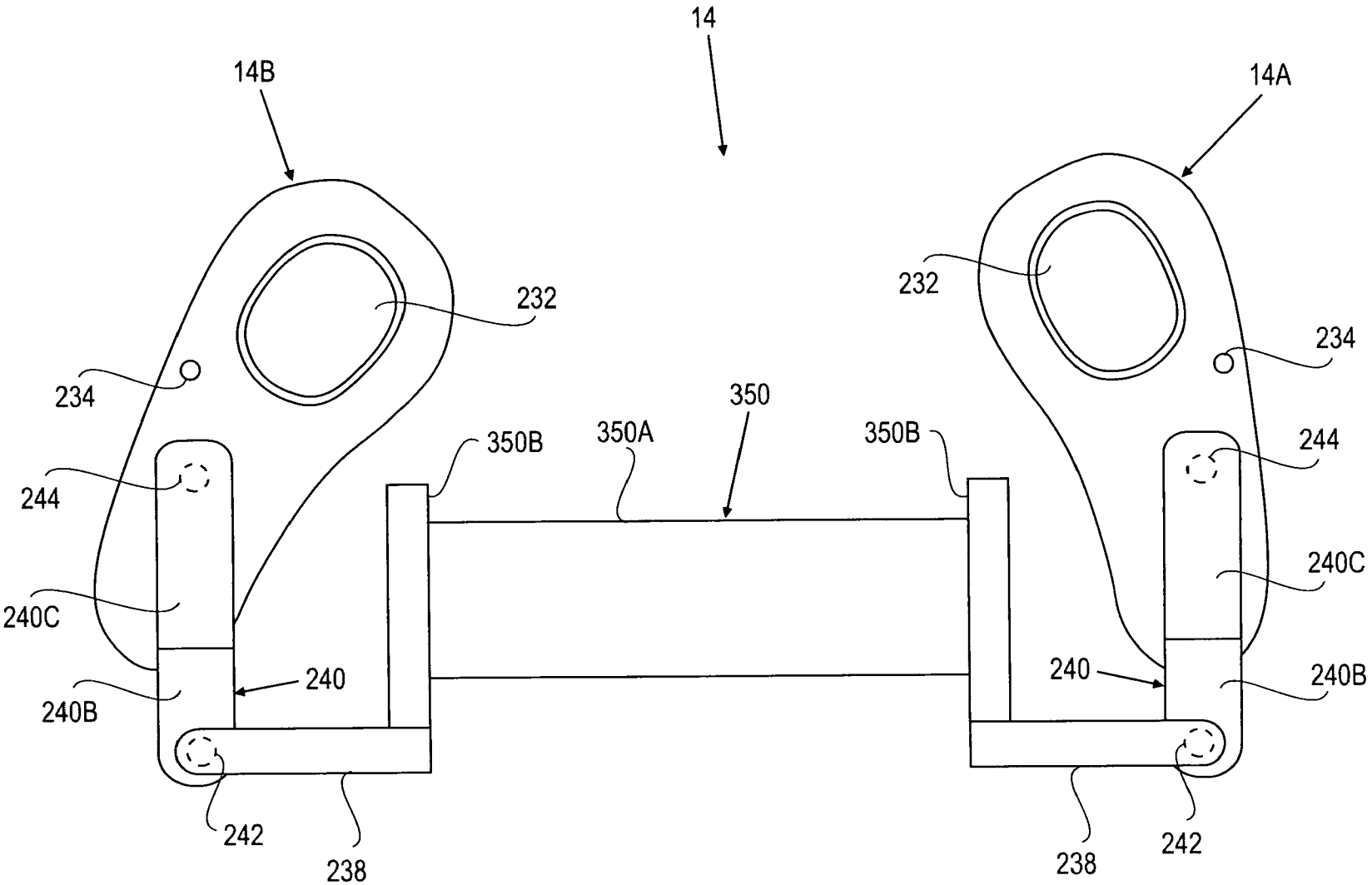
FIG. 3 is a simplified bottom view of one embodiment of an armrest assembly having features of the present invention.

FIG. 3 is a simplified bottom view of one embodiment of the armrest assembly 14, including the left armrest 14A and the right armrest 14B. This Figure also illustrates the fluid bowl 232, the device bracket 238, the angled section 240B of the frame bracket 240, the transverse section 240C of the frame bracket, the frame pivot 242 (illustrated in phantom), the support arm pivot 244 (illustrated in phantom) and the support area pivot 234.

Additionally, in the embodiment illustrated in FIG. 3, the armrest assembly 14 can include a connector frame 350 that connects the armrests 14A, 14B together and that facilitates the attachment of the armrests 14A, 14B to the resting device 12 (illustrated in FIG. 2). In one embodiment, the connector frame 350 includes a rigid center beam 350A and a pair of spaced apart rigid side beams 350B. In this embodiment, each side beam 350B is fixedly attached to the device bracket 238 of each armrest 14A, 14B.

Figure 4:
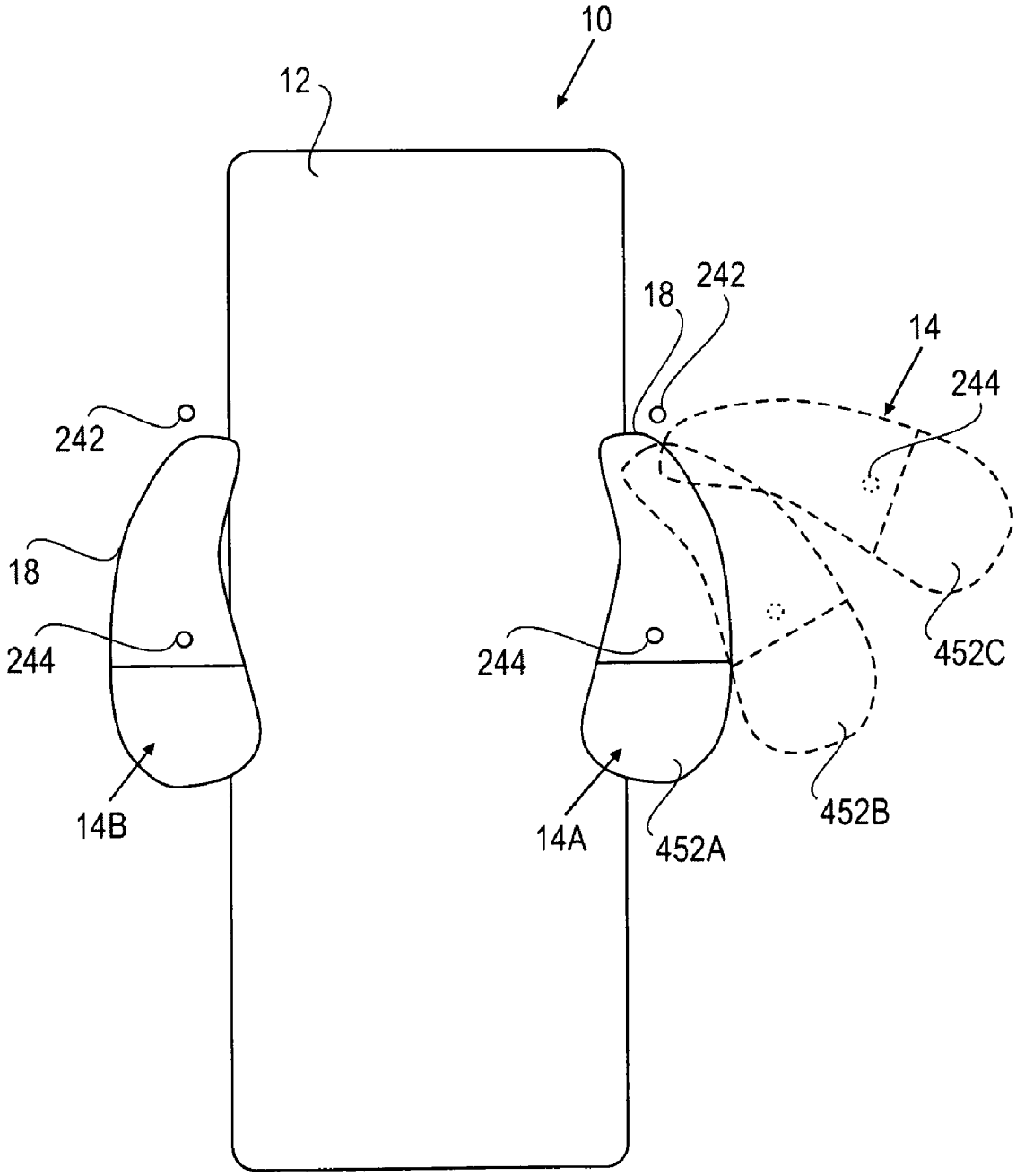
FIG. 4 is a simplified top view of the resting device assembly with a portion of the armrest assembly moved to alternative locations.

FIG. 4 is a simplified top view of the resting device assembly 10 with a portion of the armrest assembly 14 moved to alternative locations. More specifically, FIG. 4 illustrates the resting device 12, and the armrests 14A, 14B with the left armrest 14A pivoted relative to the frame pivot 242 at three alternative positions, with two of these positions illustrated in phantom. More specifically, FIG. 4 illustrates the left armrest 14A in a closed position 452A, a half-open position 452B, and a fully open position 452C. It should be noted that the closed position 452A, the half-open position 452B, and/or the fully open position 452C can alternatively be referred to as the first position, the second position, or the third position. Further, it should be noted that the right armrest 14B can be moved in a similar fashion as the left armrest 14A, and/or the left armrest 14A can be moved to any position intermediate the positions illustrated in FIG. 4.

With this design, the armrests 14A, 14B can be easily moved between the closed position 452A (positioned to support the arms of the person in a natural and comfortable posture), and the open position 452C (swung out of the way to allow the person to easily get on and get off the resting device 12).

The amount of rotation between the closed position 452A and the fully open position 452C can be varied to achieve the design requirements of the resting device assembly 10. In alternative, non-exclusive embodiments, the arm support 18 can be rotated about the frame pivot 242 between the closed position 452A and the fully open position 452C approximately 20, 30, 45, 60, 70, 80, 90, or 180 degrees.

The support arm pivot 244 is also illustrated in FIG. 4 for reference.

Figure 5:
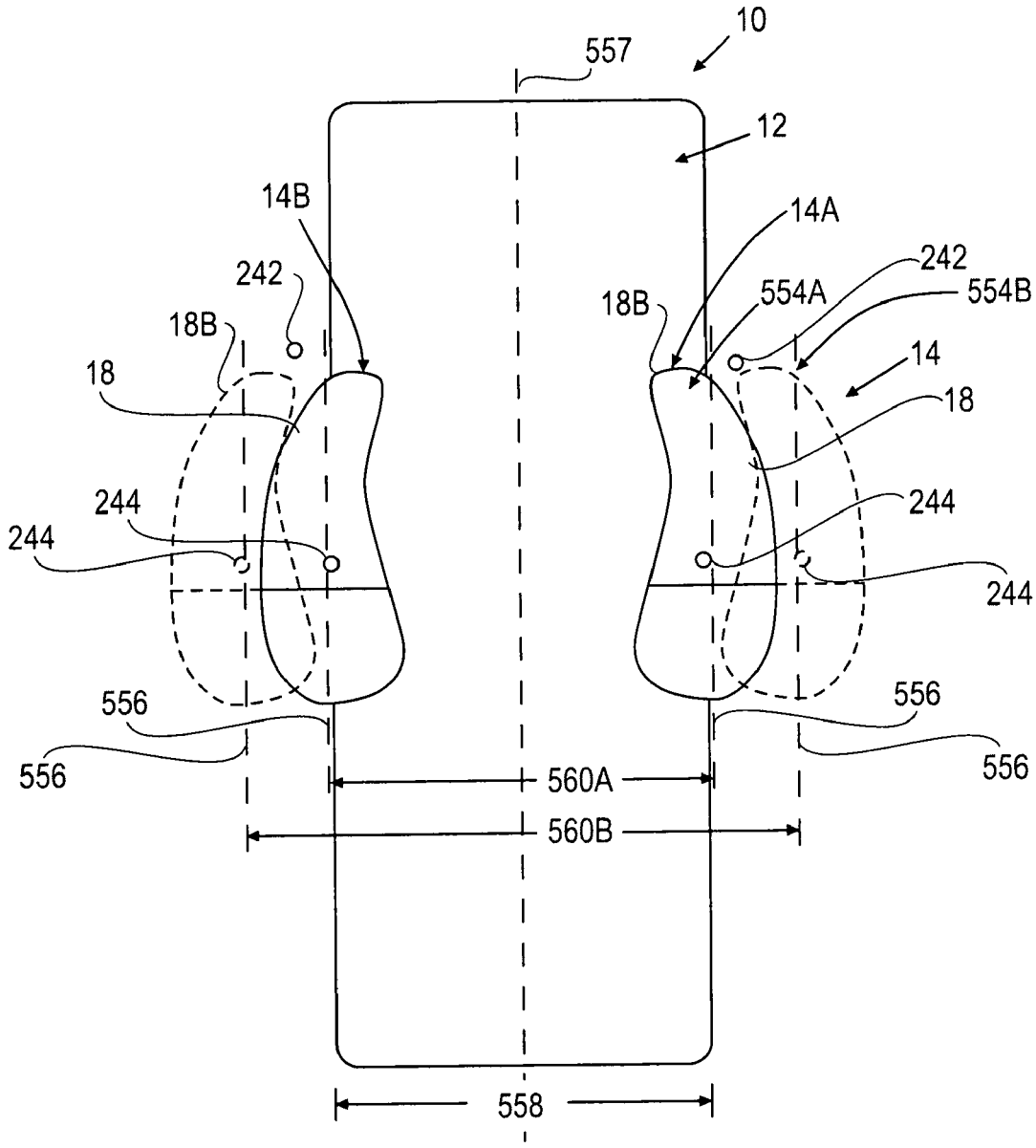
FIG. 5 is another simplified top view of the resting device assembly with a portion of the armrest assembly moved to alternative locations.

FIG. 5 is another simplified top view of the resting device assembly 10 with a portion of the armrest assembly 14 moved to alternative locations. More specifically, FIG. 5 illustrates the resting device 12, and the armrests 14A, 14B with the armrests 14A, 14B moved to two different width positions. Stated in another fashion, FIG. 5 illustrates the left armrest 14A and the right armrest 14B in a narrow width configuration 554A, and a wide width configuration 554B (illustrated in phantom). It should be noted that the narrow width configuration 554A, and/or the wide width configuration 554B can alternatively be referred to as the first configuration, or the second configuration. Further, it should be noted that each arm support 18 can be moved independently to any configurations intermediate the configurations illustrated in FIG. 5.

In certain embodiments, because each of the armrests 14A, 14B pivot at two locations, namely at the frame pivot 242 and the support arm pivot 244, the arm supports 18 can be precisely positioned and rotated to comfortably support different sized persons 15 (illustrated in FIG. 1). As illustrated in FIG. 5, because of the two pivots, the support arms 18 can be positioned at alternative width configurations 554A, 554B with a longitudinal axis 556 of each arm support 18 being substantially parallel. In this embodiment, the support arms 18 can be aligned with the spine (not shown) of the person 15, and a device longitudinal axis 557 of the resting device 12 for the comfort of the person 15. Alternatively, because of the two pivots, the support arms 18 can be positioned at alternative width configurations 554A, 554B with the longitudinal axis 556 of each arm support 18 not being substantially parallel. Basically, because of the two pivots, the arm supports 18 can be moved and positioned to suit the comfort of the person 15.

The adjustability range between the width configurations 554A, 554B can be varied to suit the design requirements of the resting device assembly 10. In one, non-exclusive example, if the resting device 12 has a device width 558 of approximately thirty inches, the support arm pivots 244 of the arm supports 18 can be spaced apart a narrow support width 560A of approximately twenty-six inches at the narrow configuration 554A, and the support arm pivots 244 of the arm supports 18 can be spaced apart a wide support width 560B of approximately forty inches at the wide configuration 554B. Thus, the arm supports can be inside of the width of the resting device 12 and outside the width of the resting device 12.

Stated in another fashion, the width between the arm support and as a percentage of the width of the chair can be adjusted to be approximately 50, 70, 100, and 125.

In FIG. 5, the frame pivot 242 is positioned past the elbow end 18B of each support arm 18. In certain embodiments, with this design, the support arms 18 can be easily moved within the width of the resting device 12.

Figure 6:
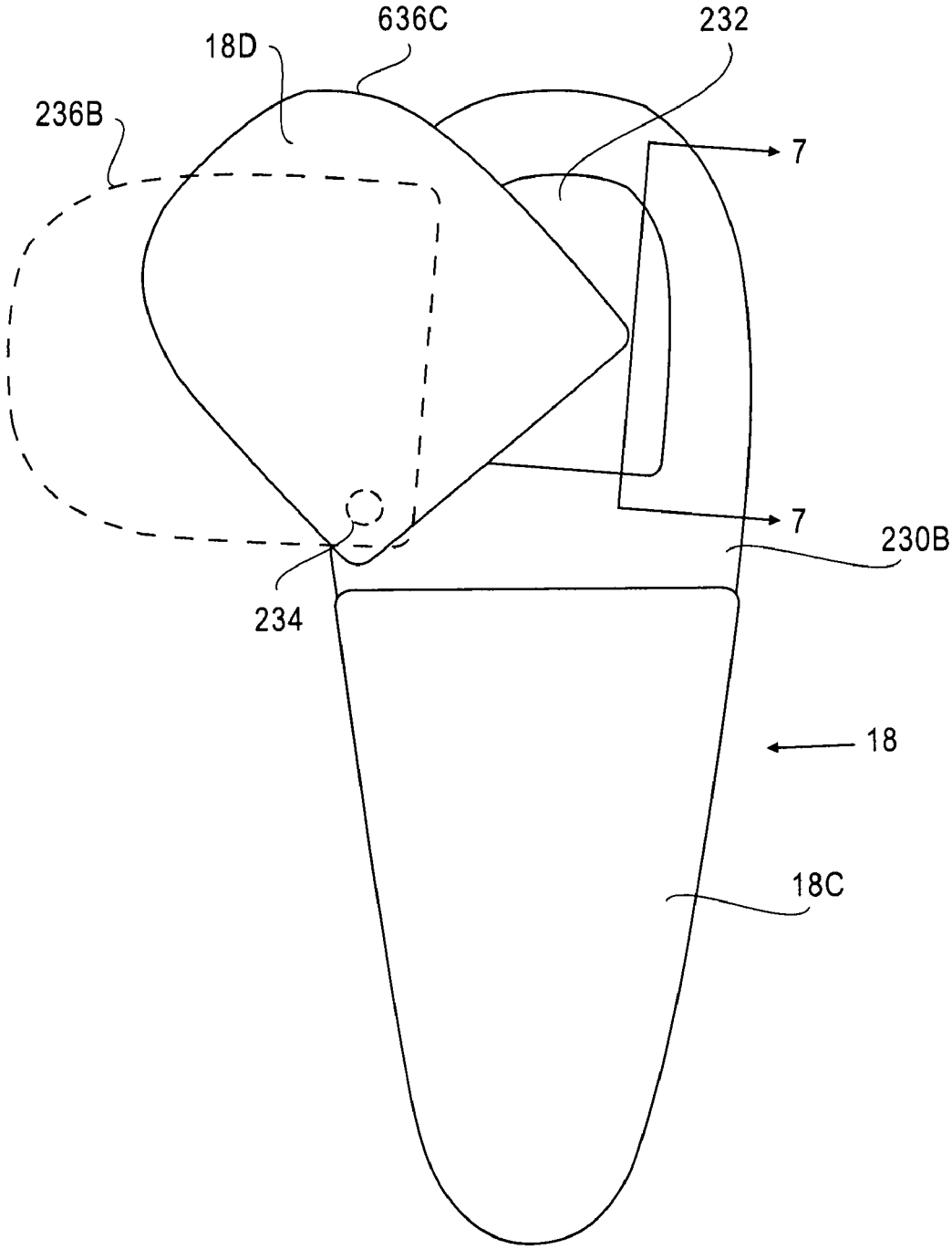
FIG. 6 is a simplified top view of a portion of the armrest assembly.

FIG. 6 is a simplified top view of a portion of one of the arm supports 18 including the support base 230B, the elbow/forearm support area 18C, the fluid bowl 232, the support area pivot 234 (illustrated in phantom), and the hand support area 18D in a partly open position 636C in which the fluid bowl 232 is partly exposed and the open position 236B (illustrated in phantom) in which the fluid bowl is fully exposed. When in the open position 236B, the fingers of the hand can be positioned in the fluid bowl 232 while the rest of the arm is comfortably supported in a natural position by the elbow/forearm support area 18C.

Further, because the hand support area 18D is moved instead of the fluid bowl 232 and the fluid bowl 232 is securely retained by the support base 230B, the likelihood of spilling the fluid 232A from the fluid bowl 232 is reduced.

Figure 7:
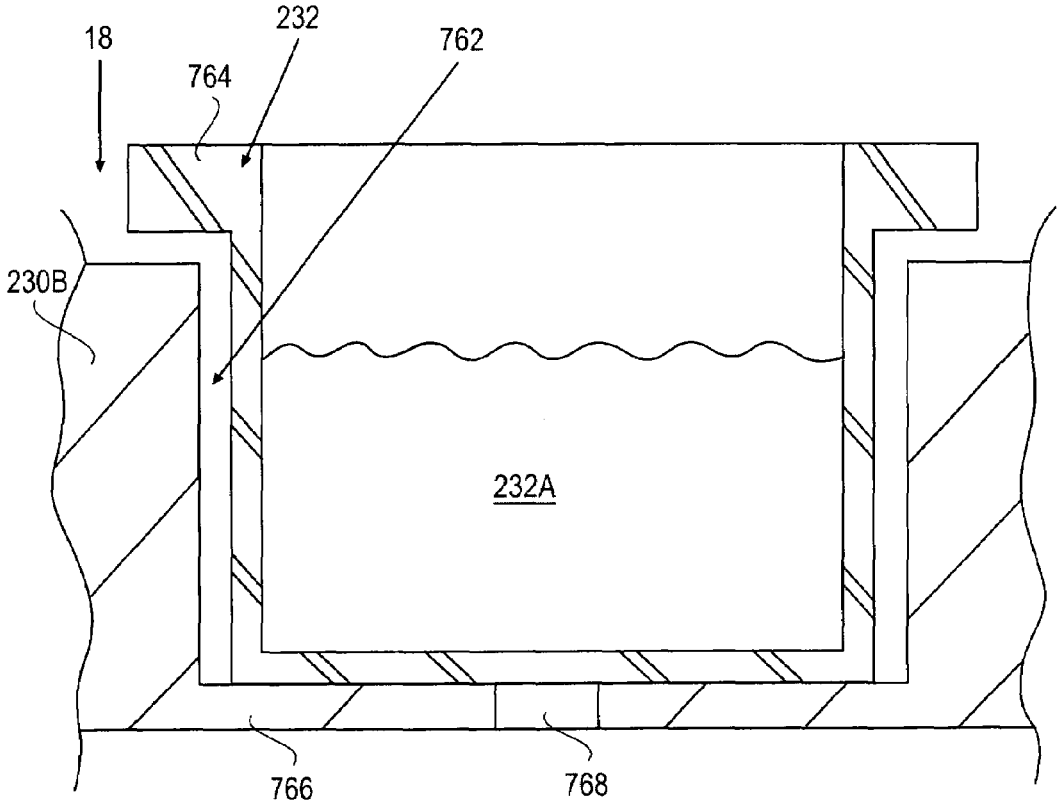
FIG. 7 is a cut-away view taken on line 7-7 of FIG. 6.

FIG. 7 is a cut-away view taken on line 7-7 of FIG. 6 that illustrates a portion of the support base 230B and the fluid bowl 232 in more detail. In one embodiment, the fluid bowl 232 can be easily inserted and removed easily from the support base 230B. With this design, the fluid bowl 232 can be moved without disturbing the fluid 232A or causing spills.

In one embodiment, the support base 230B includes a base aperture 762 that is sized and shaped to receive a portion the fluid bowl 232. Further, in this embodiment, the fluid bowl 232 can include a bowl lip 764 that allows the fluid bowl 232 to be grasped for easy removal of the fluid bowl 232.

Additionally, in one embodiment, the support base 230B includes a lower base aperture cover 766 that protects from the bottom so that accidental contact with the bottom of the arm support 18 will not push the bowl 232 upward or disturb the contents. In one embodiment, the bowl 232 can be supported and protected by a solid surface of the base aperture cover 766. Alternatively, the bowl 232 can be support by the bowl lip 764.

Further, the base aperture cover 766 can include a cover slot 768 that allows access the bottom of the bowl 232 so that the bottom of the bowl 232 can be pushed upward for ease of removal.

Figure 8:
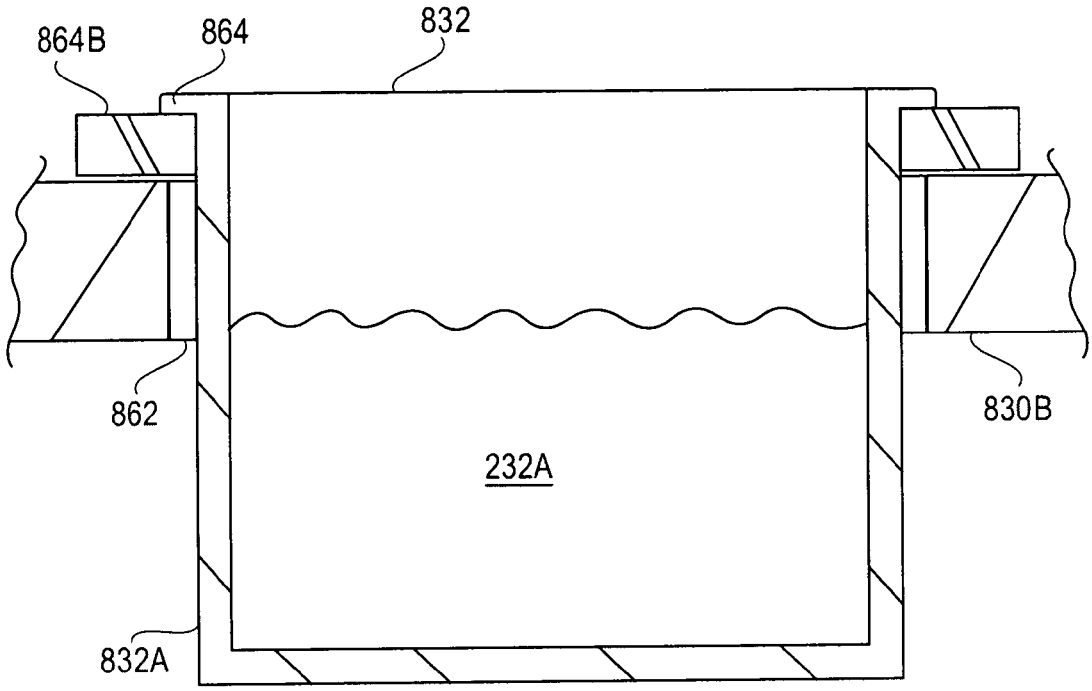
FIG. 8 is a cut-away view of another embodiment of the armrest assembly.

FIG. 8 is a cut-away view of another embodiment of a portion of the support base 830B and the fluid bowl 832. In this embodiment, the fluid bowl 832 can again be easily inserted and removed from the support base 830B without disturbing the fluid 232A or causing spills.

In this embodiment, the support base 830B again includes the base aperture 862 that is sized and shaped to receive a portion the fluid bowl 832. Further, in this embodiment, the fluid bowl 832 can includes a bowl lip 864 and a booster lip 864B that allows the fluid bowl 832 to be grasped for easy removal of the fluid bowl 832. In certain embodiments, the bowl lip 864 is relatively small, e.g. extending approximately 1/16 of an inch. In this embodiment, the booster lip 864B encircles a tubular section 832A of the fluid bowl 832 and the booster lip 864B extends outward approximately ½ inch outward. With this design, the booster lip 864B can engage the support base 830B to support the fluid bowl 832. Basically, the booster lip 864B allows for a relatively large base aperture 862 to be used (for example approximately % clearance between base aperture 862 and the tubular section 832A) for easy sliding of the fluid bowl 832 into and out of the base aperture 862. Further, the booster lip 864B provides an area to easily grab the fluid bowl 832. For example, the booster lip 864B can have a generally annular ring shape and can be made of a resilient material. Further, the booster lip 864B can slide over the bottom of the tubular section 832A up against the bowl lip 864.

While the current invention is disclosed in detail herein, it is to be understood that it is merely illustrative of the presently preferred embodiments of the invention and that no limitations are intended to the details of construction or design herein shown.

What is claimed is:

1. A resting device assembly for supporting a person during a procedure, the person having a first arm, the resting device assembly comprising:

a resting device that supports the person during the treatment, the resting device including a device frame; and a first armrest including (i) an arm support that supports the first arm, the arm support including a first support area that supports the first arm near a hand of the first arm, a second support area that supports the first arm near an elbow/forearm of the first arm, and a support area pivot that allows the first support area to pivot relative to the second support area, (ii) a frame bracket, (iii) a frame pivot that connects the frame bracket to the device frame, the frame pivot allowing the frame bracket and the arm support to concurrently pivot relative to the device frame, (iv) a support arm pivot that connects the arm support to the frame bracket, the support arm pivot allowing the arm support to pivot relative to the frame bracket, and (v) a fluid bowl that retains a fluid, the fluid bowl being secured to the arm support so that the first support area pivots relative to the fluid bowl.

2. The resting device assembly of claim 1 wherein the arm support including a hand end and an elbow end, and the support arm pivot connects to the arm support intermediate the hand end and the elbow end so that the hand end and the elbow end pivot about a support arm axis of rotation.

3. The resting device assembly of claim 2 wherein the support arm pivot connects to the arm support approximately half way between the hand end and the elbow end.

4. The resting device assembly of claim 1 wherein the first support area is pivotable between a first position in which the first support area covers the fluid bowl and a second position in which the first support area does not cover at least a portion of the fluid bowl.

5. The resting device assembly of claim 1 wherein the arm support includes a support base, wherein the fluid bowl slides into a base aperture in the support base, and wherein the fluid bowl includes a tubular section and a booster lip that extends away from the tubular section, the booster lip engaging the support base to support the fluid bowl.

6. The resting device assembly of claim 1 wherein the resting device is moveable between a seated position and a flat position.

7. A resting device assembly for supporting a person during a procedure, the person having a first arm and a second arm, the resting device assembly comprising:

a resting device that supports the person during the treatment, the resting device including a device frame; and a first armrest that is secured to the resting device, the first armrest including (i) an arm support that supports the first arm, the arm support including a padded support area having a first support area that supports the first arm near a hand of the first arm, a second support area that supports the first arm near an elbow/forearm of the first arm, and a support area pivot that allows the first support area to pivot relative to the second support area; and (ii) a fluid bowl that retains a fluid, the fluid bowl being secured to the arm support so that the first support area pivots relative to the fluid bowl.

8. The resting device assembly of claim 7 wherein the device frame supports the person above a surface, and wherein at least a portion of the device frame can be moved relative to the surface with a frame mover.

9. The resting device assembly of claim 7 wherein the first support area is pivotable between a first position in which the first support area covers the fluid bowl and a second position in which the first support area does not cover at least a portion of the fluid bowl.

10. The resting device assembly of claim 9 wherein the arm support includes a rigid support base, wherein the fluid bowl slides into a base aperture in the support base, and wherein the fluid bowl includes a tubular section and a booster lip that extends away from the tubular section, the booster lip engaging the support base to support the fluid bowl.

11. The resting device assembly of claim 10 wherein the first support area is pivotably connected to the support base, and the second support area is fixedly connected to the support base.

12. The resting device assembly of claim 7 further comprising (i) a frame bracket, (ii) a frame pivot that connects the frame bracket to the device frame, the frame pivot allowing the frame bracket and the arm support to concurrently pivot relative to the device frame, and (iii) a support arm pivot that connects the arm support to the frame bracket, the support arm pivot allowing the arm support to pivot relative to the frame bracket.

13. The resting device of claim 12 wherein the frame pivot includes a frame lock that selectively locks the frame pivot and inhibits the frame bracket from pivoting relative to the device frame.

14. The resting device assembly of claim 12 wherein the arm support including a hand end and an elbow end, and the support arm pivot connects to the arm support intermediate the hand end and the elbow end so that the hand end and the elbow end pivot about a support arm axis of rotation.

15. A method for supporting a person during a procedure, the person having a first arm and a second arm, the method comprising the steps of:

supporting the person with a resting device, the resting device including a device frame;

providing an arm support that supports the first arm;

providing a frame bracket;

connecting the frame bracket to the device frame with a frame pivot that allows the frame bracket and the arm support to concurrently pivot relative to the device frame;

connecting the arm support to the frame bracket with a support arm pivot that allows the arm support to pivot relative to the frame bracket; and securing a fluid bowl that retains a fluid to the arm support, the fluid bowl being secured to the arm support so that the first support area pivots relative to the fluid bowl.

16. The method of claim 15 wherein the arm support includes a hand end and an elbow end, and wherein the step of connecting includes the step of connecting to the arm support intermediate a hand end and an elbow end of the arm support so that the hand end and the elbow end pivot about a support arm axis of rotation.

17. The method of claim 15 wherein the arm support includes a first support area that supports a hand of the person and a second support area that supports an elbow/forearm of the person, and further comprising the step of pivoting the first support area relative to the second support area.

18. The method of claim 15 further comprising the step of pivoting the first support area relative to the second support area between a first position in which the first support area covers the fluid bowl and a second position in which the first support area does not cover at least a portion of the fluid bowl.

19. The resting device assembly of claim 1 wherein the device frame supports the person above a surface, and wherein at least a portion of the device frame can be moved relative to the surface with a frame mover.

20. The resting device of claim 1 wherein the frame pivot includes a frame lock that selectively locks the frame pivot and inhibits the frame bracket from pivoting relative to the device frame.

21. A resting device assembly for supporting a person during a procedure, the person having a first arm, the resting device assembly comprising:

a resting device that supports the person during the treatment, the resting device including a device frame and a padded region that is selectively moveable between a seated position and a flat bed position; and a first armrest including (i) an arm support that supports the first arm, the arm support including a first support area that supports the first arm near a hand of the first arm, a second support area that supports the first arm near an elbow/forearm of the first arm, and a support area pivot that allows the first support area to pivot relative to the second support area, (ii) a frame bracket, (iii) a frame pivot that connects the frame bracket to the device frame, the frame pivot allowing the frame bracket and the arm support to concurrently pivot relative to the device frame, (iv) a support arm pivot that connects the arm support to the frame bracket, the support arm pivot allowing the arm support to pivot relative to the frame bracket, and (v) a removable fluid bowl that retains a fluid, the fluid bowl being selectively secured to the arm support.

22. The resting device assembly of claim 21 wherein the first support area selectively covers the removable fluid bowl.

23. The resting device assembly of claim 22 wherein the first support area is padded.

24. The resting device assembly of claim 21 wherein the first support area is selectively pivotable between a closed position and an open position, the first support area covering the removable fluid bowl when it is in the closed position, and the removable fluid bowl being exposed when the first support area is in the open position.

25. The resting device of claim 21 wherein the frame pivot includes a frame lock that selectively locks the frame pivot and inhibits the frame bracket from pivoting relative to the device frame.

* * * * *